US006592198B2

(12) United States Patent
Shoji et al.

(10) Patent No.: US 6,592,198 B2
(45) Date of Patent: Jul. 15, 2003

(54) RECORDING APPARATUS WITH CONTROL OF A RECORDING MEDIUM CONVEYING MECHANISM

(75) Inventors: Michiharu Shoji, Kanagawa (JP); Nobutsune Kobayashi, Kanagawa (JP); Hiroyuki Saito, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/983,724

(22) Filed: Oct. 25, 2001

(65) Prior Publication Data

US 2002/0051026 A1 May 2, 2002

(30) Foreign Application Priority Data

Oct. 31, 2000 (JP) ..... 2000-332710

(51) Int. Cl.[7] ..... B41J 29/38; B41J 11/42

(52) U.S. Cl. ..... 347/16; 271/265.01; 346/134; 399/381; 400/582

(58) Field of Search ..... 347/16; 346/134; 399/381; 400/582; 271/265.01

(56) References Cited

U.S. PATENT DOCUMENTS 3,323,700 A * 6/1967 Epstein et al. ..... 226/17
3,949,856 A * 4/1976 Ulber et al. ..... 400/579
4,591,969 A * 5/1986 Bloom et al. ..... 700/78
6,371,593 B1 * 4/2002 Li et al. ..... 347/19

OTHER PUBLICATIONS

U.S. patent application Ser. No. 09/905,876, filed Jul. 17, 2001 pending.
U.S. patent application Ser. No. 09/983,578, filed Oct. 25, 2001 pending.
U.S. patent application Ser. No. 09/983,725, filed Oct. 25, 2001 pending.

* cited by examiner

*Primary Examiner*—John Bariow
*Assistant Examiner*—Blaise Mouttet
(74) *Attorney, Agent, or Firm*—Fitzpatrick, Cella, Harper & Scinto

(57) ABSTRACT

A recording apparatus includes a conveying mechanism control unit which performs a first processing and a second processing almost simultaneously, when it is detected that a recording medium has reached a stop position. The first processing is to make invalid the output of a servo computing device and make effective the output in accordance with an output-for-stop setting register. The second processing is to generate an auto stop interrupt to inform that the output in accordance with the output-for-stop setting register is made effective. With this configuration, the recording apparatus enables the increase in speed of a stop operation control processing of a DC motor for use in conveying a recording medium and the improvement of the stop position accuracy of the recording medium.

8 Claims, 11 Drawing Sheets

RECORDING APPARATUS WITH CONTROL OF A RECORDING MEDIUM CONVEYING MECHANISM

BACKGROUND OF THE INVENTION

1. Field of the Invention

The present invention relates to control of a recording medium conveying mechanism of a recording apparatus which produces records with recording heads and conveys a recording medium in a predetermined amount by means of a DC motor.

2. Related Background Art

Ink-jet recording apparatus, which are mounted on printers, facsimiles and copiers, are widely used as means for recording images (including characters and symbols) on recording media, such as paper and plastic thin sheet (OHP), based on image information.

There is shown in FIG. 8 a schematic structural view of the recording medium conveying unit of one example of the above described ink-jet recording apparatus.

A recording medium 201 is supported by a conveying roller 202 placed in a recording section and conveyed in the direction shown by the arrow α in the figure by the conveying roller 202 when driving a conveying motor 203. As the conveying motor 203, a stepping motor or a DC motor is used. Nowadays, however, a DC motor is used more often because of its quietness, etc. When using a DC motor, a rotary encoder, not shown in the figure, is installed in the conveying roller 202 and the conveying motor 203 is controlled based on encoder signals sent from the encoder.

In front of the conveying roller 202, shafts 204 are provided in parallel therewith. And a carriage 205 performs a reciprocating motion on the shafts 204 in the direction shown by the arrow β when the drive action of a carriage motor 206 is transmitted to the carriage 205 via a belt 207. Between the shafts 204 and the carriage 205, lubricating oil such as grease is applied so as to decrease the mechanical loading caused due to the friction between them. As the carriage motor 206, a stepping motor or a DC motor is used, like the conveying motor 203. Nowadays, however, a DC motor is used more often because of its quietness, etc. When using a DC motor as the carriage motor 206, a linear encoder, not shown in the figure, is arranged on the carriage 205 and a linear encoder scale, not shown in the figure, is arranged in parallel with the shafts 204. And the carriage motor 206 is controlled based on signals obtained from the linear encoder.

The carriage 205, as means for moving recording heads, is mounted with recording heads 208 and tanks 209 which contain recording ink. The recording heads 208 shown in FIG. 8 are for use in producing color images, and a head for black 208-BK, a head for cyan 208-C, a head for magenta 208-M and a head for yellow 208-Y are arranged in this order in a scan direction of the carriage 205. And tanks 209-BK, 209-C, 209-M, 209-Y for respective black (BK), cyan (C), magenta (M) and yellow (Y) supply the inks to the heads corresponding to the respective colors. On the front surface of each recording head 208, that is, on a surface which faces the recording area of the recording medium 201 spaced at a fixed distance (eg. 0.8 mm) apart therefrom, an ink ejection portion is provided in which multiple (for example, 48 or 64) ink ejection orifices are arranged in a column in the direction intersecting the scanning direction of the carriage.

A control unit containing a control circuit (CPU) of the recording apparatus and ROM and RAM, all of which are not shown in the figure, receives information on a recording mode and recording data from a controller of an external host computer via, for example, the interface. And the control unit controls each recording head via head driving circuits and the driving sources such as various types of motors, based on the received information and data, whereby ink, etc. is ejected and records are produced on the recording medium 201.

As a method of controlling motor torque when using a DC motor for each of the carriage motor and the conveying motor, one is known in which an enable signal, which controls on/off of motor driver output, and phase signal, which controls the direction of motor rotation, are subjected to PWM (Pulse Width Modulation) control.

The relationships between the motor supply torque and the control waveform (duty factor DUTY) at the time of subjecting the enable signal to PWM control are shown in FIGS. 9A to 9C and those at the time of subjecting the phase signal to PWM control are shown in FIGS. 10A to 10C, respectively. The enable signal determines on/off of the output directed to the motors; for example, when the enable signal is low, output is disabled and when the enable signal is high, output is enabled. As shown in FIGS. 9A to 9C, when high level duty factor of the waveform is 0%, the motor supply torque output is 0%, when the duty factor 50%, the torque output 50%, and when the duty factor 100%, the torque output 100%, provided that the maximum output torque of the motors is 100%.

On the other hand, the phase signal determines the direction of motor rotation; for example, when the phase signal is low, the motor rotates in the reverse direction and when the phase signal is high, the motor rotates in the forward (or normal) direction. As shown in FIGS. 10A to 10C, when the high level duty factor of the waveform is 50%, the motor generates the same magnitude of torque in the forward and reverse directions, and therefore, is in the stopped state. In other words, when the high level duty factor of the waveform is 50%, the motor supply torque generated is 0%, when the duty factor is 75% (duty factor 25%), the torque generated is 50% in the forward direction (50% in the reverse direction), and when the duty factor is 100% (duty factor 0%), the torque generated is 100% in the forward direction (100% in the reverse direction).

Then, a control flowchart when using a DC motor as the conveying motor is shown in FIG. 11. The control in a DC motor servo has been performed by software computing via CPU. The information required for the servo is obtained from the encoder signal, and the encoder signal is processed using hardware such as ASIC. The software reads the position and speed information obtained from the encoder signal at intervals of servo cycle, for example, of 1 ms and performs servo computing processing to control the DC motor. The stop position of the recording medium is detected by the hardware, such as ASIC, which sends an interrupt signal to the CPU, and this interrupt allows the software to know that the recording medium reaches the stop position. After the Start (s501), upon the occurrence of interrupt (s502), the software decides what the content of the interrupt is (s503). If the decision is that the interrupt is not stop position interrupt, the software performs regular interrupt handling corresponding to the content of the interrupt (s504). If the interrupt is decided to be stop position interrupt, the software sets PWM output for stop and drives accordingly (s505), and then resets the interrupt (s506). Then the software verifies the stop position (s507); and, if the stop position is out of position, the stop position is corrected (s508). After verifying the stop position, a recording operation (s509) is executed and the control is completed (s510).

However, in the motor control of the prior art described above, the motor does not stop until multiple steps, that is, occurrence of interrupt, decision of the content of interrupt and setting/execution of PWM output for stop are executed after the recording medium reaches the stop position. Since the conveying motor continues to operate during the execution of each of the above steps, a problem of lowering the stop position accuracy has sometimes arisen.

Further, in order to avoid causing variation in time of executing PWM output for stop due to the occurrence of waiting for the interrupt, it has been necessary to raise the priority of stop position interrupt to the highest.

SUMMARY OF THE INVENTION

Accordingly, an object of this invention is to provide a recording apparatus which enables the speed up of a stop operation control processing of a DC motor for use in conveying a recording medium and the improvement of the stop position accuracy of the recording medium.

Another object of this invention is to provide a recording apparatus which is independent of the priority of an interrupt process related to the stop position of a DC motor, and hence high in degree of design freedom.

Still another object of this invention is to provide a recording apparatus which includes conveying means for conveying a recording medium, a conveying motor for driving the conveying means, servo computing means for controlling the output directed to the conveying motor based on servo computing results obtained using software, position detecting means for detecting the position of the recording medium by counting the number of encoder signal edges, a stop position setting register for setting a stop position of the recording medium, position comparing means for comparing the position detected by the position detecting means with that set by the stop position setting register, and conveying motor output switching means for selectively switching the output from the servo computing means and the output from an output-for-stop setting register. The recording apparatus further includes a conveying mechanism control unit which performs a first processing and a second processing almost simultaneously, when it is detected by the position comparing means that the recording medium has reached the stop position. The first processing is to make invalid the output of the servo computing means by the conveying motor output switching means and make effective the output in accordance with the output-for-stop setting register. The second processing is to generate an auto stop interrupt to inform that the output in accordance with the output-for-stop setting register is made effective.

Another object of this invention is to provide a recording apparatus which includes conveying means for conveying a recording medium, a conveying motor for driving the conveying means, servo computing means for controlling the output directed to the conveying motor based on the servo computing results obtained using software, position detecting means for detecting the position of the recording medium by counting the number of the encoder signal edges, a stop position setting register for setting a stop position of the recording medium, a position comparing means for comparing the position detected by the position detecting means with that set by the stop position setting register, and conveying motor output switching means for selectively switching the output from the servo computing means and the output from an output-for-stop setting register. The recording apparatus further includes a conveying mechanism control unit in which when it is detected that the recording medium has reached the stop position by the position comparing means, and the conveying motor output switching means, the position comparing means generates an auto stop interrupt to inform that the output in accordance with the output-for-stop setting register is made effective, and make the output from the output-for-stop setting register effective a certain time after the occurrence of the auto stop interrupt.

DETAILED DESCRIPTION OF THE PREFERRED EMBODIMENTS

Figure 1:
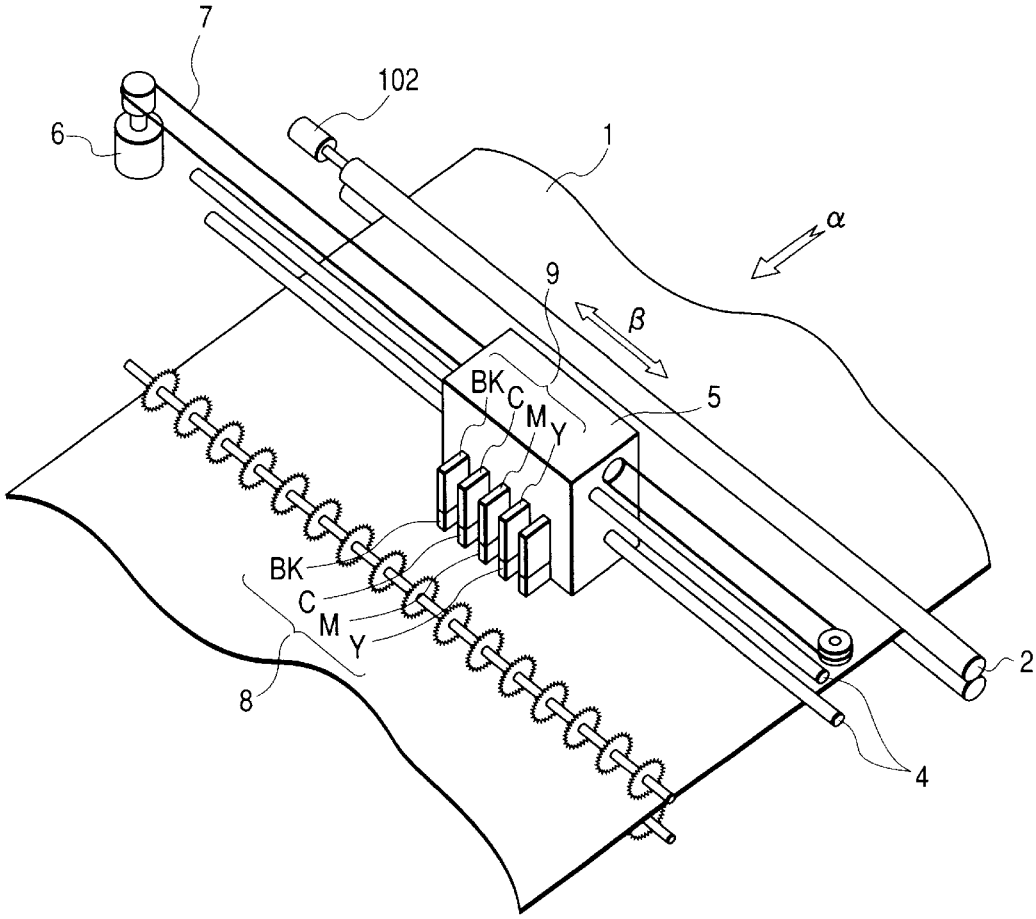
FIG. 1 is a schematic structural view of the recording medium conveying unit of an ink-jet recording apparatus in accordance with a first embodiment of the present invention.

In the following the embodiments of the invention will be described in detail with reference to the accompanying drawings.

It should be noted that the present invention is not limited to these embodiments as illustrated in the drawings.

First Embodiment

Referring first to FIG. 1, there is shown a schematic structural view of a recording medium conveying unit of an ink-jet recording apparatus of the first embodiment.

A recording medium 1 is supported by conveying rollers 2 which are arranged in a recording area and conveyed in the direction shown by the arrow α in the figure by driving a conveying motor (DC motor) 102. In the conveying roller 2 a rotary encoder, not shown in the figure, is installed, and the conveying motor 102 is controlled based on an encoder signal given by the encoder.

In front of the conveying rollers 2, shafts 4 are provided in parallel therewith. A carriage 5 performs a reciprocating motion on the shafts 4 in the direction shown by the arrow β when a driving action of a carriage motor 6 is transmitted to the carriage 5 via a belt 7. Between the shafts 4 and the carriage 5, lubricating oil such as grease is applied so as to decrease the mechanical loading caused due to the friction between them. A linear encoder, not shown in the figure, is arranged on the carriage 5 and a linear encoder scale, not shown in the figure, is arranged in parallel with the shafts 4. The carriage motor 6 is controlled based on signals obtained from the linear encoder.

The carriage 5, as means for moving recording heads, is mounted with recording heads 8 and tanks 9 which contain recording ink. The recording heads 8 are for use in producing color images, and a head for black 8-BK, a head for cyan 8-C, a head for magenta 8-M and a head for yellow 8-Y are arranged in this order in a scan direction of the carriage 5. Tanks 9-BK, 9-C, 9-M, 9-Y for respective black (BK), cyan (C), magenta (M) and yellow (Y) colors supply ink to the heads corresponding to the respective colors. On a front surface of each recording head 8, that is, on a surface which faces the recording area of the recording medium 1 spaced at a fixed distance (e.g., 0.8 mm) apart therefrom, an ink ejection portion is provided in which multiple (for example, 48 or 64) ink ejection orifices are arranged in a column in the direction intersecting the scan direction of the carriage.

A control unit, which will be described later, containing a control circuit (CPU) of the recording apparatus and ROM and RAM receives information on a recording mode and recording data from the controller of an external host computer via, for example, the interface. And the control unit controls each recording head via head driving circuits and driving sources such as various types of motors, based on the received information and data, whereby inks are ejected and recording is conducted on the recording medium 1.

Figure 2:
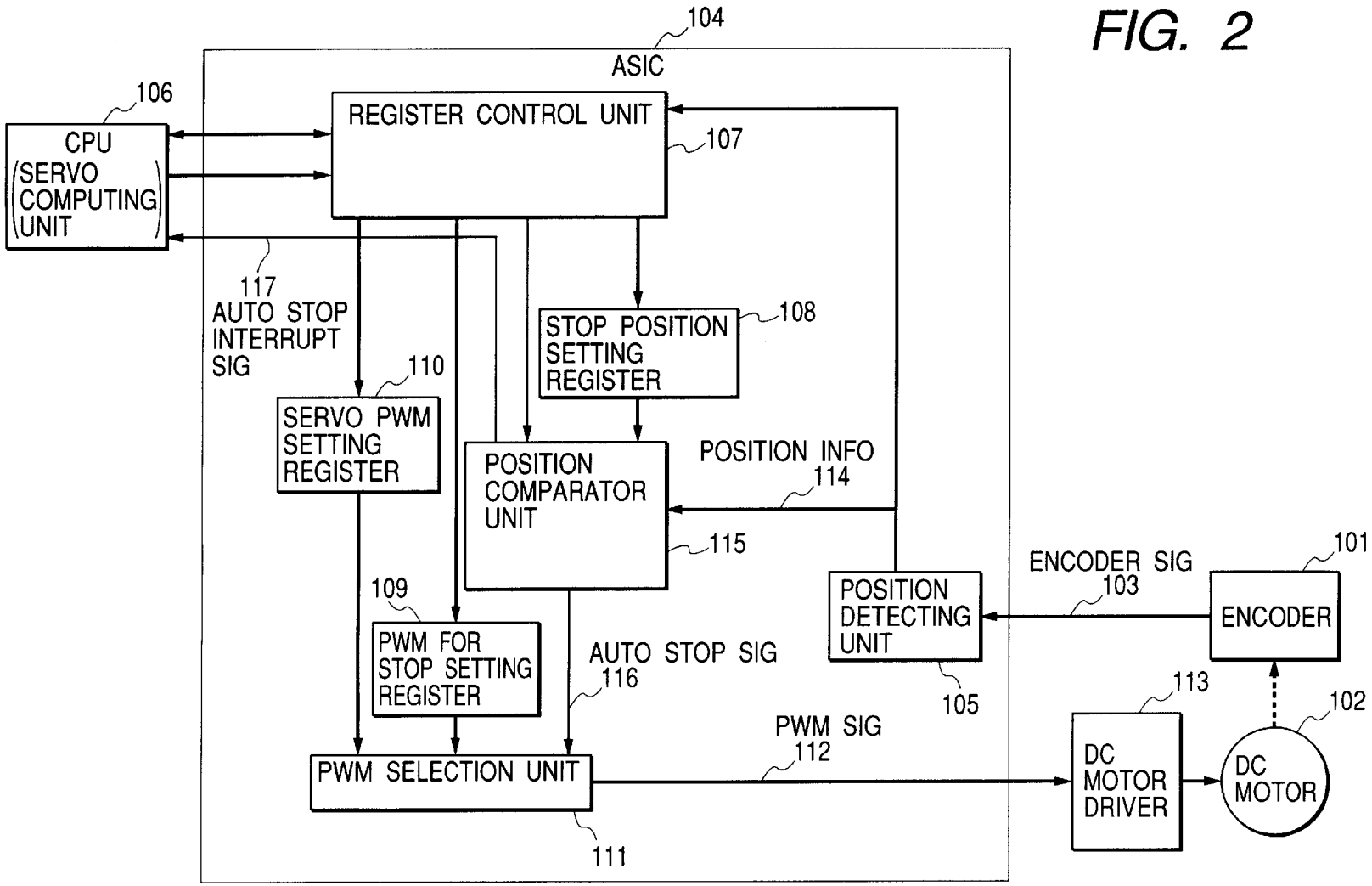
FIG. 2 is a control block diagram illustrating the control of a DC motor of a recording medium conveying mechanism in accordance with the first embodiment of the present invention.
Figures 3A, 3B, 3C, 3D, 3E, 3F, 3G:
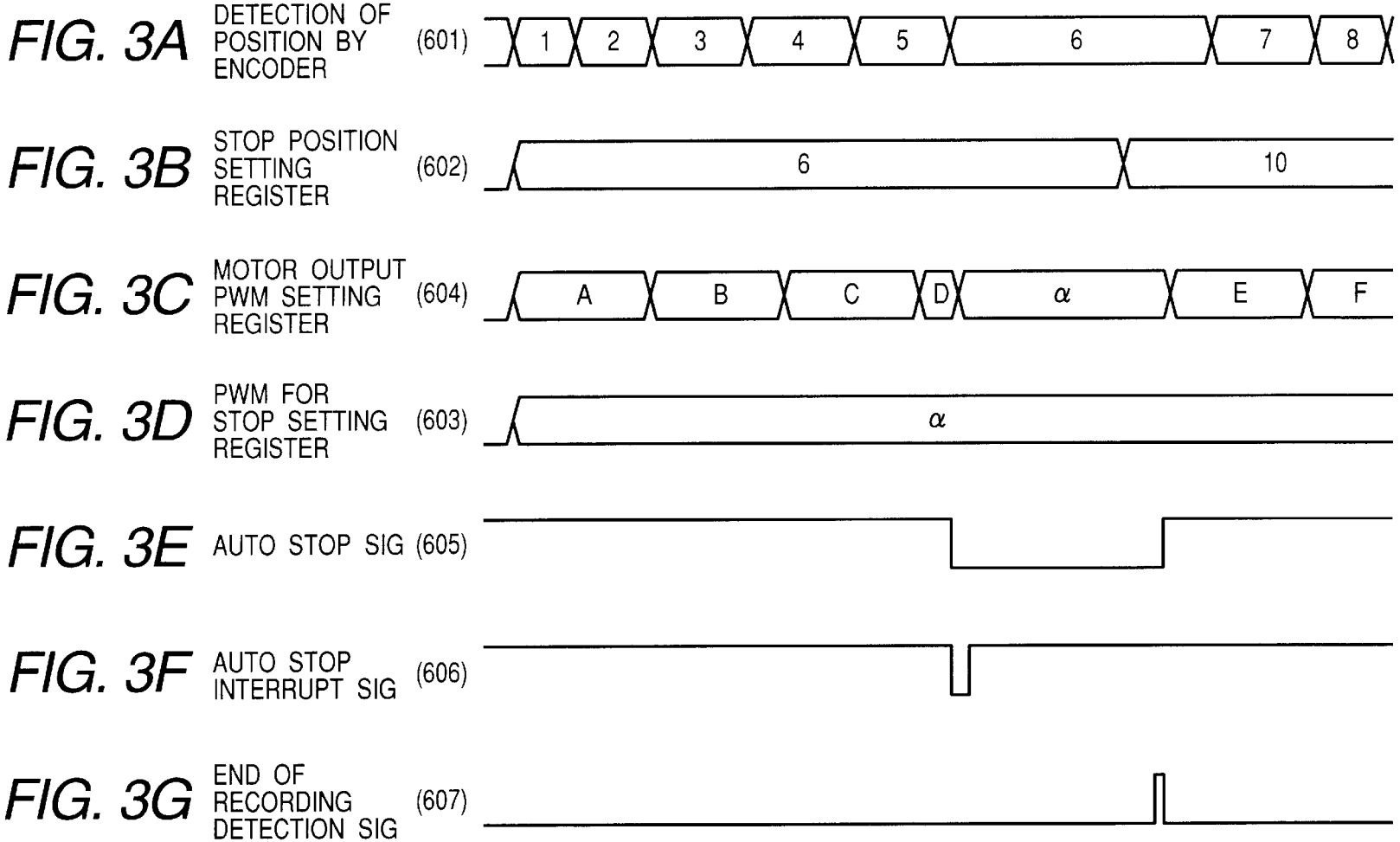
FIGS. 3A, 3B, 3C, 3D, 3E, 3F and 3G are timing charts illustrating the control of the DC motor of the recording medium conveying mechanism in accordance with the first embodiment of the invention.

Referring now to FIG. 2, there is shown a control block diagram illustrating the control of the DC motor of a recording medium conveying mechanism of this embodiment.

The control block of the recording medium conveying mechanism of this embodiment includes a CPU (servo computing unit) 106 for controlling an output directed to the DC motor 102 based on the servo computing results obtained using software; an ASIC 104 including a position detecting unit 105 for detecting a position of the recording medium 1 by counting the number of the edges of the encoder signal 103, a stop position setting register 108 for setting a stop position of the recording medium 1, a PWM for stop setting register 109 for setting an output of the DC motor 102 for stop, a position comparator unit 115 for comparing a position of the recording medium 1 detected by the position detecting unit 105 with that set by the stop position setting register 108, and a PWM selection unit 111 for selectively switching the output from the CPU (servo computing unit) 106 and the output from the PWM for stop setting register 109; and a motor driver 113 for controlling the DC motor 102 based on the PWM signal 112 output from the PWM selection unit 111.

An encoder 101 outputs the encoder signal 103 according to the motion of the DC motor 102. The encoder signal 103 is sent to the position detecting unit 105 within the ASIC 104, and the position detecting unit 105 performs position counting at all times. The CPU (servo computing unit) 106 writes on each register or reads from it selectively via a register control unit 107 within the ASIC 104. The CPU (servo computing unit) 106 sets the stop position in the stop position setting register 108 and a PWM value for stop in the PWM for stop setting register 109 before starting to drive the DC motor 102. The CPU (servo computing unit) 106 reads position information from the position detecting unit 105 at intervals of servo cycle, performs computation based on the information it has read, and sets the thus computed PWM value in a servo PWM setting register 110. The PWM selection unit 111 generates a PWM signal according to the PWM value set in the servo PWM setting register 110. The generated PWM signal 112 is sent to the DC motor driver 113, and the motor output in accordance with the PWM signal 112 is directed to the DC motor 102, whereby the DC motor 102 is driven. When the DC motor 102 is driven and the recording medium reaches the stop position, the position comparator unit 115 comparing the position information 114 counted by the position detecting unit 105 with the value of the stop position setting register 108 detects that the recording medium has reached the stop position. Upon that detection, the position comparator unit 115 sends an auto stop signal 116 to the PWM selection unit 111 and also sends an auto stop interrupt signal 117 to the CPU (servo computing unit) 106. The PWM selection unit 111 into which the auto stop signal 116 is entered outputs immediately the PWM signal 112 in accordance with the PWM for stop setting register, and at the same time inhibits the acceptance from the servo PWM setting register 110. Thus, the DC motor driver 113 sends to the DC motor 102 the output in accordance with the PWM signal 112 indicating the stop state, whereby the DC motor is suspended. The CPU (servo computing unit) 106 having received the auto stop interrupt signal 117 detects the DC motor going into the stop mode, reads the position information from the position detecting unit 105, verifies the stop position, and executes recording operations.

Referring now to FIGS. 3A to 3G, there are shown timing charts illustrating the control of the DC motor of the recording medium conveying mechanism of this embodiment.

An encoder detected position 601 is the position of the recording medium 1 detected by increasing/decreasing the counted value in accordance with the encoder signal 103. A stop position (6) is set in a stop position setting register 602 and a PWM value for stop (α) is set in a PWM for stop setting register 603 before driving the DC motor. In a motor output PWM setting register 604 for the DC motor being driven are set PWM values (A, B, C, D . . . ) set by the CPU (servo computing unit) 106, and in accordance with these values, PWM signals for controlling the DC motor are generated. Immediately when the encoder detected position 601 and the value of the stop position setting register 602 coincide, an auto stop signal 605 is made low (PWM output for stop) and an auto stop interrupt signal 606 is made low (auto stop operation occurrence). When the auto stop signal 605 becomes PWM output for stop (low), the PWM value for stop (α) in the PWM for stop setting register 603 is automatically input into a motor output PWM setting register 604 and PWM output in accordance with this value is generated. If the servo computing unit sets a PWM value while the auto stop signal 605 is low, the setting is ignored and the value of the PWM for stop setting register 603 remains effective. Then, if an end of recording detection signal 607 occurs, the auto stop signal 605 is changed to servo PWM output (high), and the control of the DC motor is returned to the regular DC motor driving by the servo. The end of recording detection signal 607 occurs when recording by the recording heads 8 terminates, but it may be output when it is required that the auto stop signal 605 changes from the PWM output for stop (low) to the servo PWM output (high).

Figure 4:
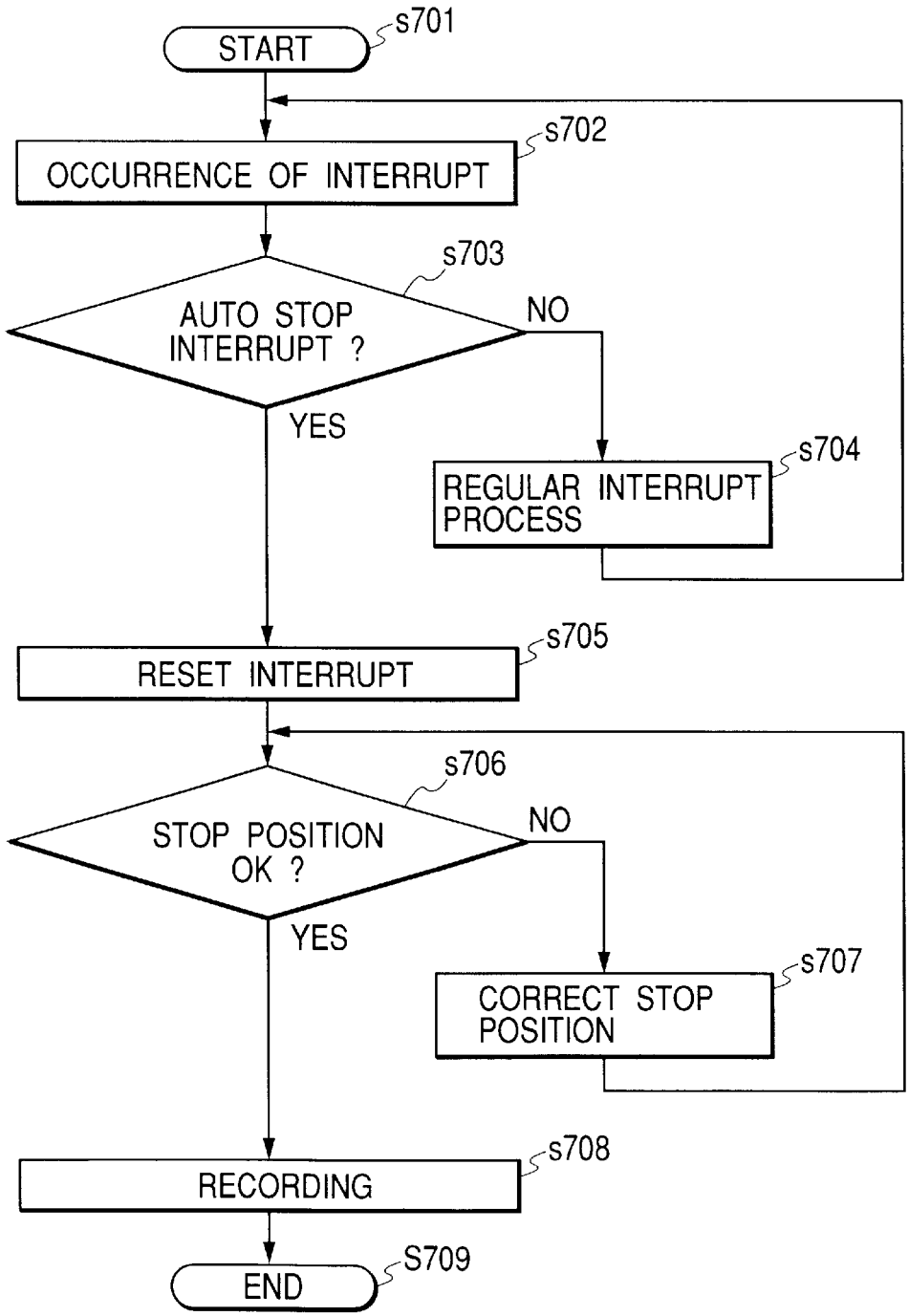
FIG. 4 is a flowchart illustrating the control of the DC motor of the recording medium conveying mechanism in accordance with the first embodiment of the present invention.

Referring now to FIG. 4, there is shown a flowchart illustrating the control of the DC motor of the recording medium conveying mechanism of this invention.

After the starting (s701), upon knowing the occurrence of interrupt (s702), the control decides what the content of the interrupt is (s703). If the interrupt is not an auto stop interrupt, the control performs a regular interrupt process corresponding to the content of the interrupt (s704). If the interrupt is the auto stop interrupt, the control resets it (s705). Then the control verifies the stop position (s706), and if the stop position is out of position, the control corrects it (s707). After verifying the stop position, the control executes a recording operation (s708) and ends (s709).

As described so far, according to the recording apparatus of this embodiment, the control related to the stop operation of the DC motor is not executed by the servo computing unit of the CPU, but performed within the ASIC, so that the speed-up of processing is realized. The DC motor goes into the stop mode immediately when the recording medium reaches the stop position, and thus the stop position accuracy is improved.

Further, according to the recording apparatus of this embodiment described above, it is not necessary to raise the priority of the interrupt handling related to the stop operation of the DC motor to the highest. Therefore, the degree of design freedom can be enhanced.

Second Embodiment

Figure 5:
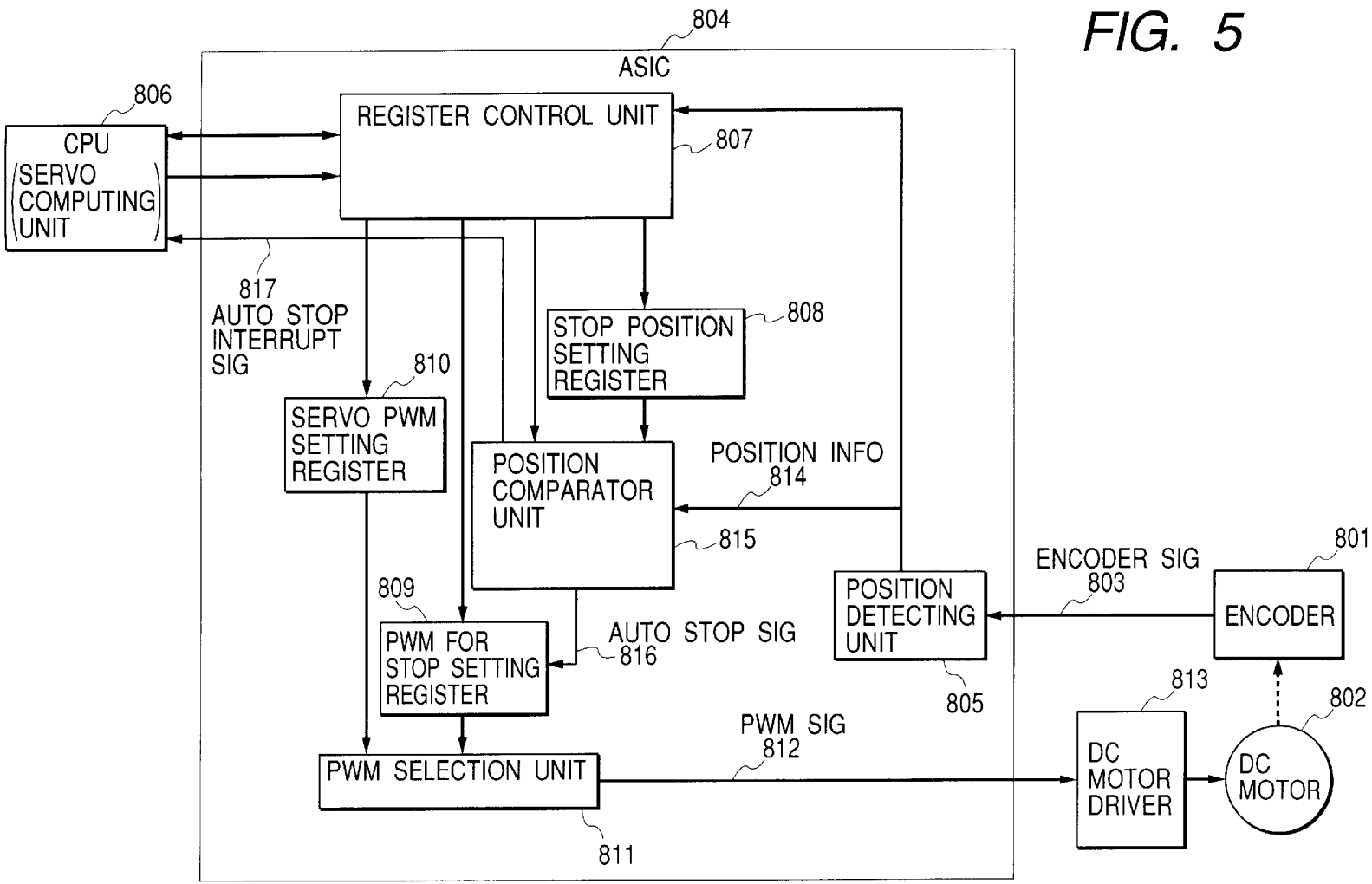
FIG. 5 is a control block diagram illustrating the control of a DC motor of a recording medium conveying mechanism in accordance with a second embodiment of the present invention.
Figures 6A, 6B, 6C, 6D, 6E, 6F:
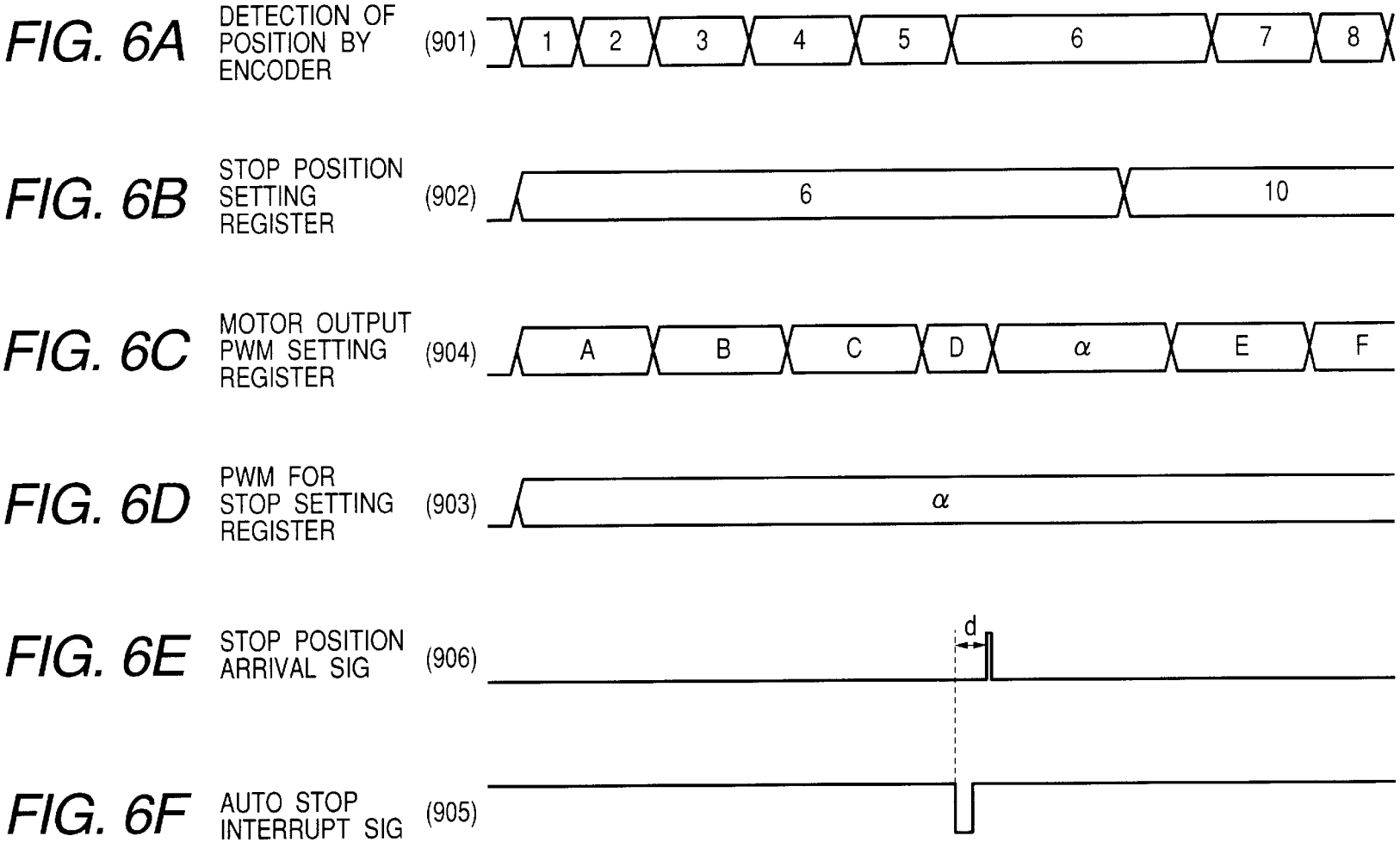
FIGS. 6A, 6B, 6C, 6D, 6E and 6F are timing charts illustrating the control of the DC motor of the recording medium conveying mechanism in accordance with the second embodiment of the present invention.

Referring to FIG. 5, there is shown a control block diagram illustrating the control of the DC motor of the recording medium conveying mechanism of the second embodiment.

First, the difference in control between the first and second embodiments will be roughly described.

In the first embodiment, the auto stop signal 116 is input into the PWM selection unit 111, which inhibits the acceptance from the servo PWM setting register 110. And at the same time, the PWM signal 112 in accordance with the PWM for stop setting register is directed to the DC motor driver 113. In other words, the DC motor 102 is stopped by the signal from the PWM selection unit 111, and even if the CPU (servo computing unit) 106 outputs an operation instruction, since the PWM selection unit 111 does not accept the servo PWM setting register 110, the operation instruction is never output from the PWM selection unit 111 to the DC driver 113 as a PWM signal 112. This allows the DC motor 102 to remain in the stopped state.

On the other hand, in this embodiment, in order for the CPU (servo computing unit) 806 to have time to fully identify the auto stop interrupt, the CPU (servo computing unit) 806 outputs no signal which operates a DC motor 802 after the DC motor 802 enters in the stopped state.

In the following, this embodiment will be described in detail. However, the structure of the ink-jet recording apparatus of this embodiment is the same as that of the ink-jet recording apparatus shown in FIG. 1, except that the method of controlling the recording medium conveying mechanism, which is to be described below, is different from that of the first embodiment. Therefore, the detailed description will be omitted in other parts. In the following description, reference numerals different from those of FIG. 1 will be used to denote each constituent, signal, etc. For example, the DC motor 102 shown in FIG. 1 is denoted with reference numeral 802.

For the regular operations of an encoder 801, a DC motor 802, an encoder signal 803, an ASIC 804, a position detecting unit 805, a CPU (servo computing unit) 806, a register control unit 807, a stop position setting register 808, a PWM for stop setting register 809 and a servo PWM setting register 810, the description will be omitted since they are the same as those of FIG. 1. However, a PWM value for stop set in the PWM for stop setting register 809 is not sent to the PWM selection unit 811 until a stop position arrival signal 816 is sent from the position comparator unit 815.

The PWM selection unit 811 generates a PWM signal according to the PWM value set in the servo PWM setting register 810. The PWM selection unit 811 generates the PWM signal 812 according to the value sent last between the PWM for stop setting register 809 and the servo PWM setting register 810. The generated PWM signal 812 is sent to the DC motor driver 813, and the motor output in accordance with the PWM signal 812 is directed to the DC motor 802, whereby the DC motor 802 is driven.

When the DC motor 802 is driven and the recording medium reaches the stop position, the position comparator unit 815 comparing the position information 814 counted by the position detecting unit 805 with the value of the stop position setting register 808 detects that the recording medium has reached the stop position. Upon that detection, the position comparator unit 815 sends an auto stop interrupt signal 817 to the CPU (servo computing unit) 806. Then, after a certain time has elapsed which allows the CPU (servo computing unit) 806 to fully identify the above auto stop interrupt and stop the servo output, the position comparator unit 815 sends the stop position arrival signal 816 to the PWM for stop setting register 809. The PWM for stop setting register 809 into which the stop position arrival signal 816 is entered transfers the PWM value for stop to the PWM selection unit 811. And the PWM selection unit 811 immediately outputs the PWM signal 812 in accordance with the PWM value for stop. This allows the DC motor driver 813 to direct the output in accordance with the PWM signal 812 in the stopped state to the DC motor 802 to enter in the stopped state. The CPU (servo computing unit) 806 having received the auto stop interrupt signal 817 detects that the DC motor has fallen into the stop mode, reads the position information from the position detecting unit 805, verifies the stop position, and executes the recording operation.

Referring now to FIGS. 6A to 6F, there are shown timing charts illustrating the control of the DC motor of the recording medium conveying mechanism of this embodiment.

An encoder detected position 901 is the position of the recording medium 1 detected by increasing/decreasing the counted value in accordance with the encoder signal 803. A stop position (6) is set in a stop position setting register 902 and a PWM value for stop ($\alpha$) is set in a PWM for stop setting register 903 before driving the DC motor. In a motor output PWM setting register 904 for the DC motor being driven are set PWM values (A, B, C, D . . . ) set by the CPU (servo computing unit) 806, and in accordance with these values, PWM signals for controlling the DC motor are generated. Immediately when the encoder detected position 901 and the value of the stop position setting register 902 coincide, an auto stop interrupt signal 905 is made low (auto stop operation occurrence). Then, after a certain time d has elapsed which allows the servo computing unit to fully identify the change in the auto stop interrupt signal 905 and stop the servo output, a stop position arrival signal 906 (one shot) is produced. When the stop position arrival signal 906 (one shot) is produced, the motor output PWM setting register 904 is rewritten with the information (α) stored in the PWM for stop setting register 903, and PWM output in accordance with this value is generated.

Figure 7:
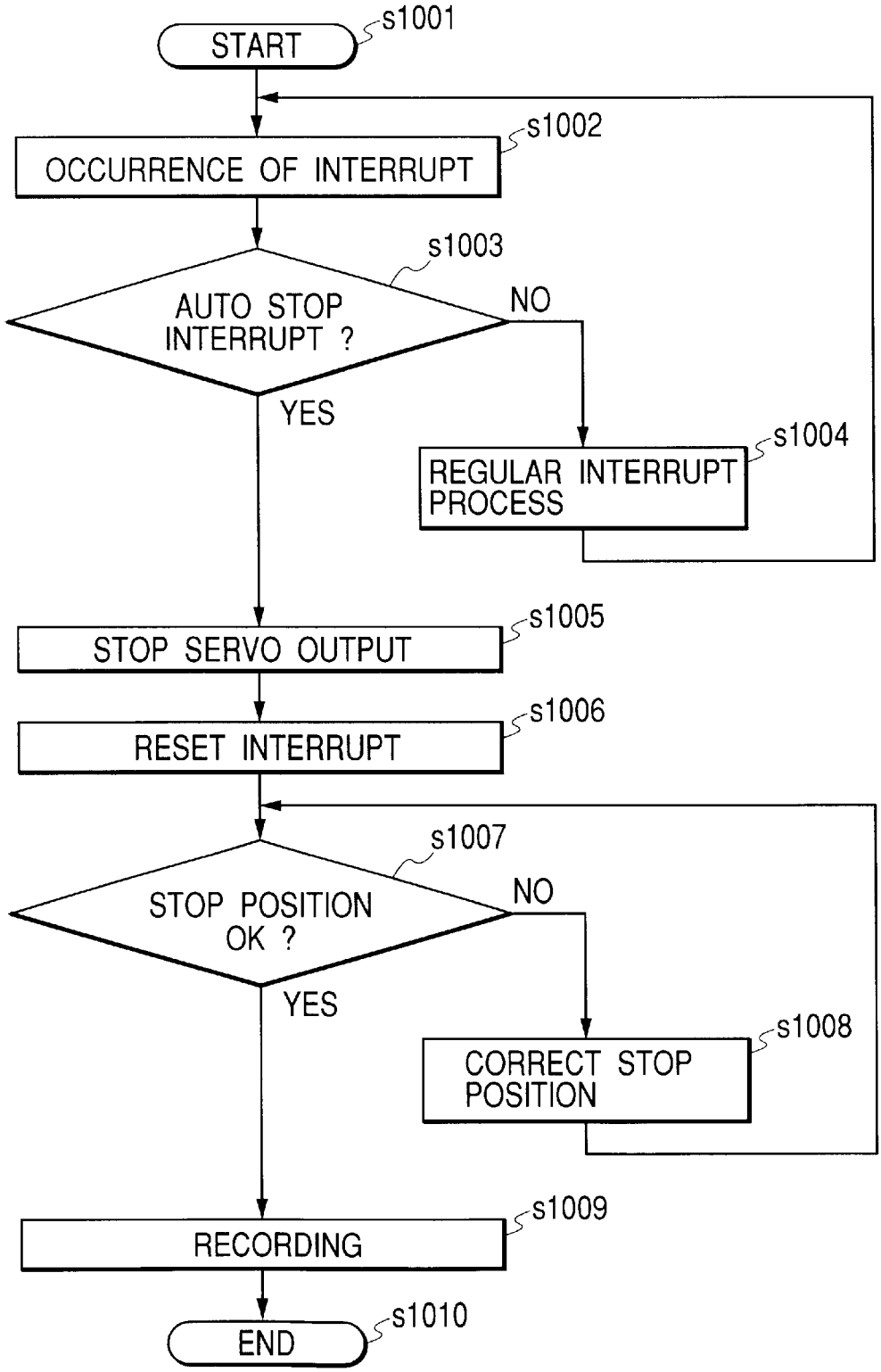
FIG. 7 is a flowchart illustrating the control of the DC motor of the recording medium conveying mechanism in accordance with the second embodiment of the present invention.
Figure 8:
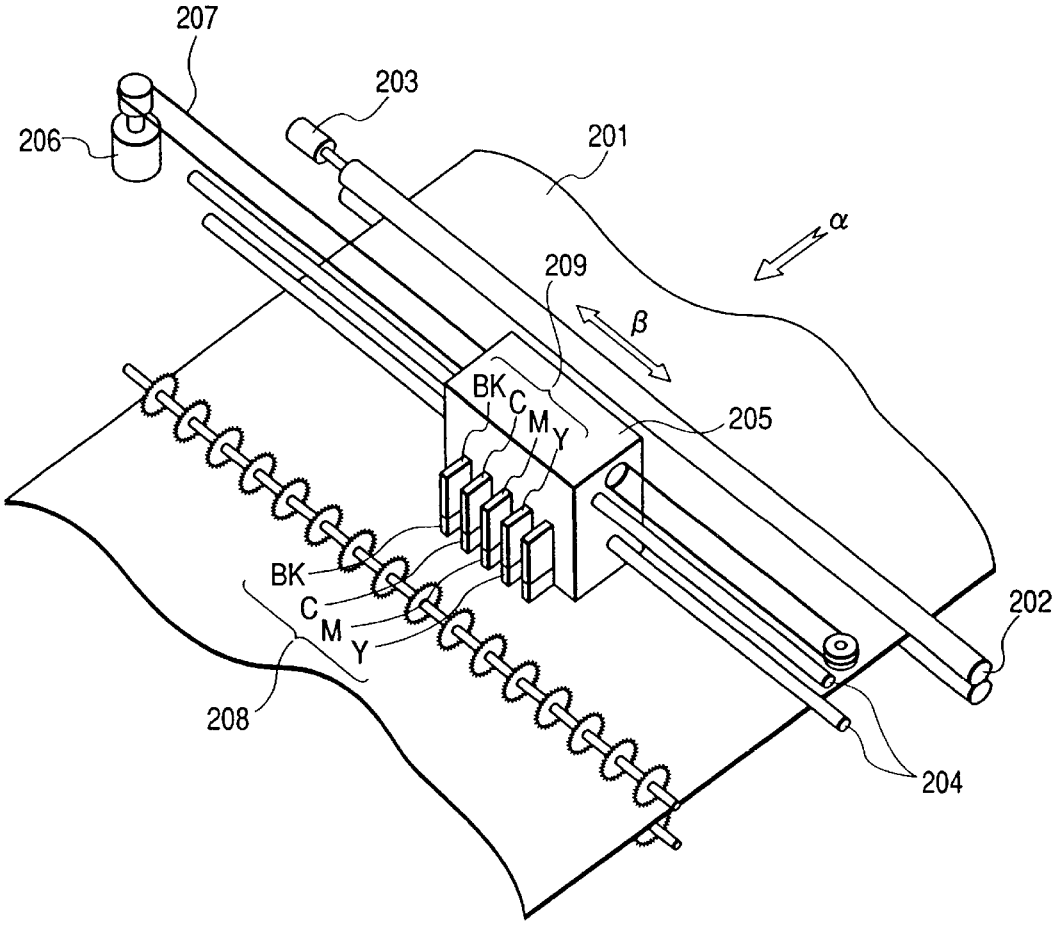
FIG. 8 PRIOR ART
FIG. 8 is a schematic structural view of a recording medium conveying unit of an ink jet recording apparatus of the prior art.
Figures 9A, 9B, 9C:
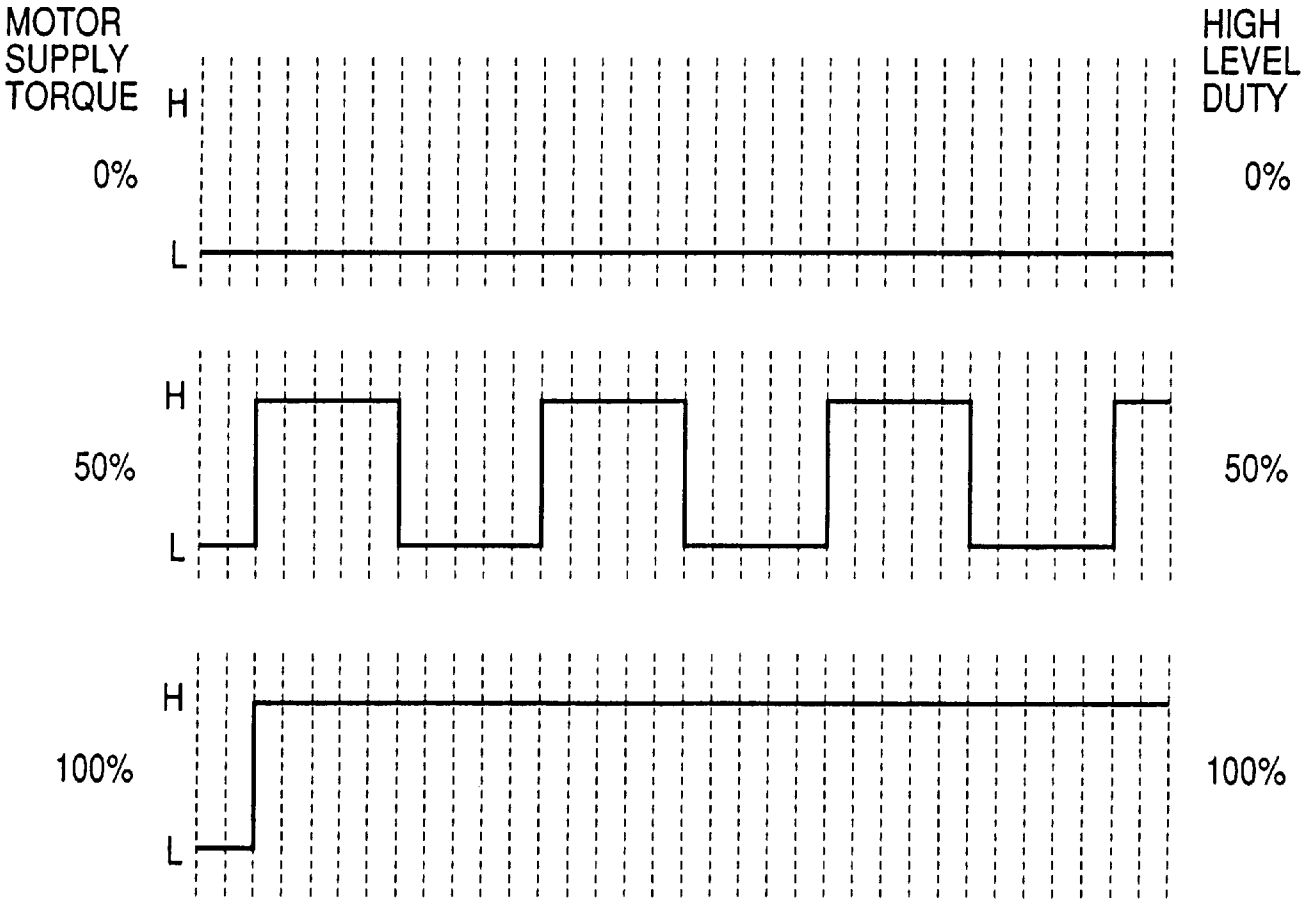
FIG. 9A PRIOR ART
FIG. 9B PRIOR ART
FIG. 9C PRIOR ART
FIGS. 9A, 9B and 9C are graphs illustrating the waveforms subjected to PWM control by the enable signal.
Figures 10A, 10B, 10C:
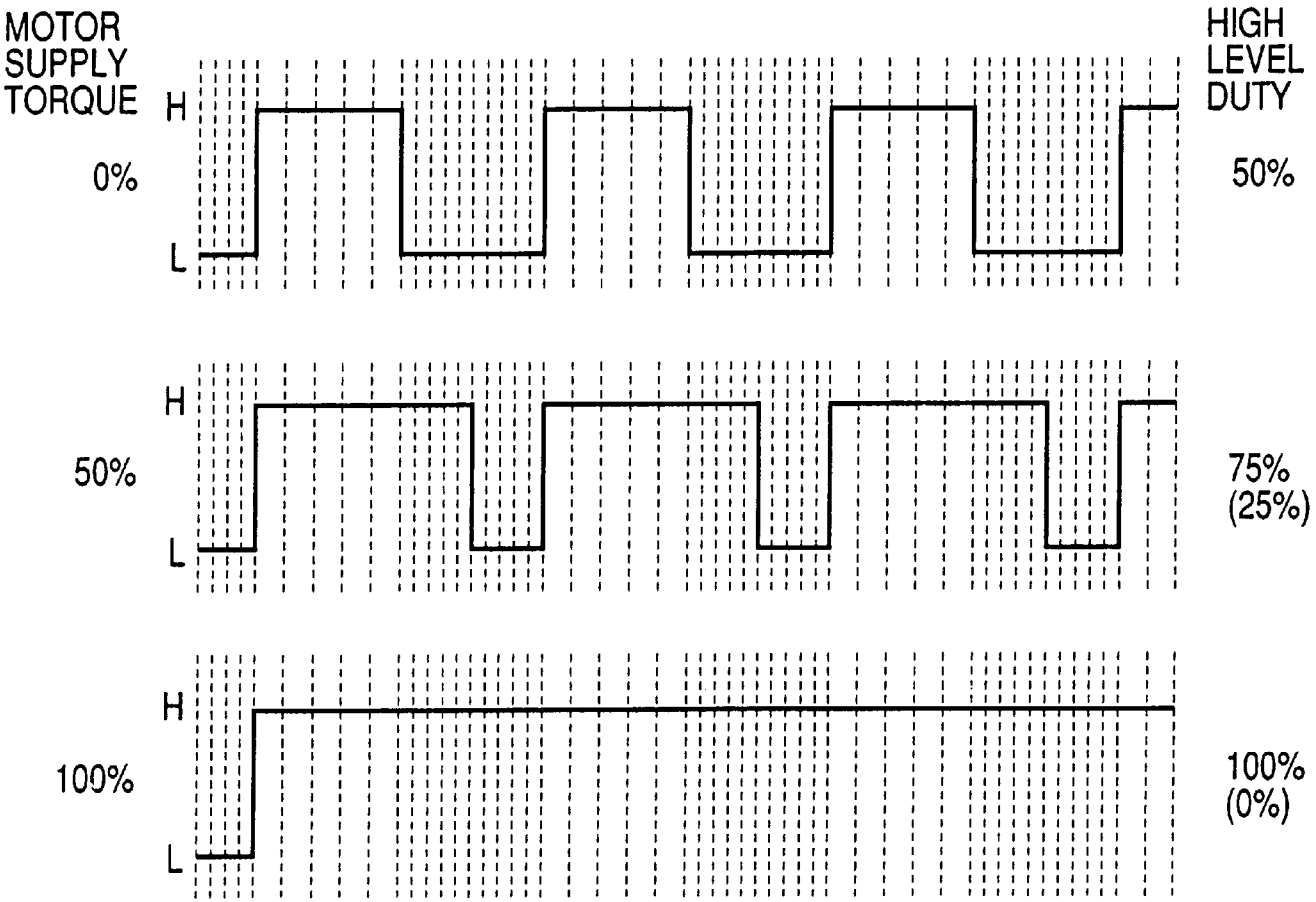
FIG. 10A PRIOR ART
FIG. 10B PRIOR ART
FIG. 10C PRIOR ART
FIGS. 10A, 10B and 10C are graphs illustrating the waveforms subjected to PWM control by the phase signal.
Figure 11:
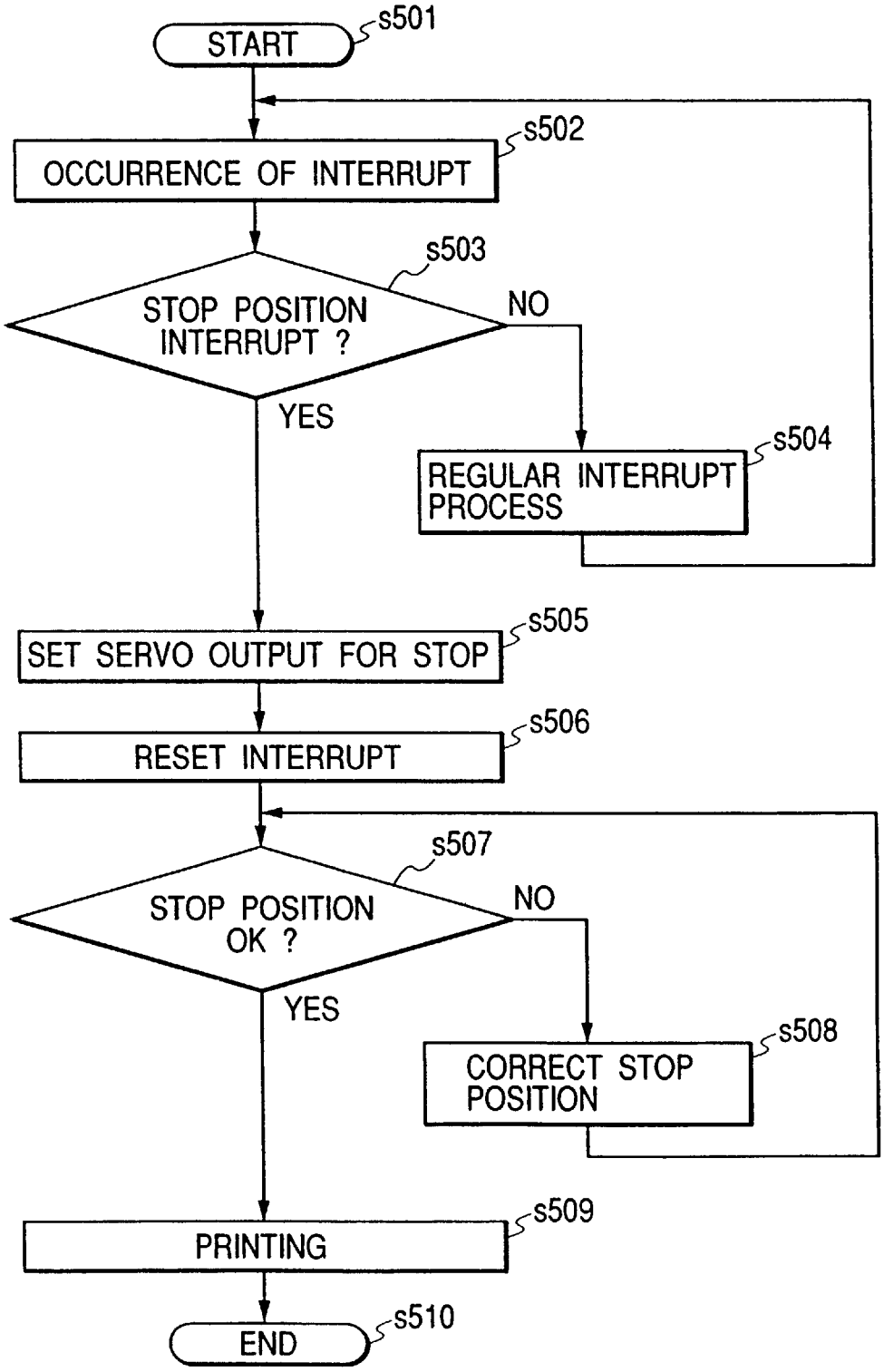
FIG. 11 PRIOR ART
FIG. 11 is a flowchart illustrating the control of a DC motor in a recording medium conveying mechanism of the prior art.

Referring now to FIG. 7, there is shown a flowchart illustrating the control of the DC motor of the recording medium conveying mechanism of this invention.

After the starting (s1001), upon knowing the occurrence of interrupt (s1002), the control decides what the content of the interrupt is (s1003). If the interrupt is not an auto stop interrupt, the control performs a regular interrupt process corresponding to the content of the interrupt (s1004). If the interrupt is the auto stop interrupt, the control stops the servo output (s1005) and then resets the interrupt (s1006). Thereafter, the control verifies the stop position (s1007), and if the stop position is out of position, the control corrects it (s1008). After verifying the stop position, the control executes the recording operation (s1009) and ends (s1010).

As described so far, according to the recording apparatus of this embodiment, the control related to the stop operation of the DC motor is not executed by the servo computing unit of the CPU, but performed within the ASIC, just like the first embodiment, so that the speed-up of processing is realized. The DC motor goes into the stop mode immediately when the recording medium reaches the stop position, and thus the stop position accuracy is improved.

Further, according to the recording apparatus of this embodiment described above, it is not necessary to raise the priority of the interrupt handling related to the stop operation of the DC motor to the highest. Therefore, the degree of design freedom can be enhanced.

As described above, according to this embodiment, the control related to the stop operation of the conveying motor is not performed based on the servo computing results obtained by using the software of the servo computing means, but executed by the conveying mechanism control unit. Therefore, the servo computing means need not take over a burden and the processing is speeded up.

Further, since the servo computing means does not participate in the control of the stop operation of the conveying motor, it is not necessary to consider the priority of the interrupt handling related to the stop operation of the conveying motor toward the servo computing means, resulting in enhancement of the degree of design freedom.

What is claimed is:

1. A recording apparatus, comprising:

conveying means for conveying a recording medium;

a conveying motor for driving the conveying means;

servo computing means for controlling the output directed to the conveying motor based on servo computing results obtained using software;

position detecting means for detecting the position of the recording medium by counting the number of the edges of an encoder signal;

a stop position setting register for setting a stop position of the recording medium;

position comparing means for comparing the position of the recording medium detected by the position detecting means with that set by the stop position setting register;

conveying motor output switching means for selectively switching the output from the servo computing means and the output from an output-for-stop setting register; and a conveying mechanism control unit for performing a first processing and a second processing almost simultaneously, when it is detected by the position comparing means that the recording medium has reached the stop position, wherein, said first processing is to make invalid the output of the servo computing means by the conveying motor output switching means and make effective the output in accordance with the output-for-stop setting register, and said second processing is to generate an auto stop interrupt to inform that the output in accordance with the output-for-stop setting register is made effective.

2. The recording apparatus according to claim 1, wherein the conveying motor output switching means continues to make invalid the output of the servo computing means until it receives conveying motor output switching means for selectively switching the output from the output-for-stop setting register and the output of the servo computing means after the completion of the first processing.

3. The recording apparatus according to claim 1, wherein the conveying motor is a DC motor.

4. The recording apparatus according to claim 1, wherein the recording apparatus is an ink-jet recording apparatus.

5. A recording apparatus, comprising:

conveying means for conveying a recording medium;

a conveying motor for driving the conveying means;

servo computing means for controlling the output directed to the conveying motor based on servo computing results obtained using software;

position detecting means for detecting the position of the recording medium by counting the number of the edges of an encoder signal;

a stop position setting register for setting a stop position of the recording medium;

a position comparing means for comparing the position of the recording medium detected by the position detecting means with that set by the stop position setting register;

conveying motor output switching means for selectively switching the output from the servo computing means and the output from an output-for-stop setting register; and a conveying mechanism control unit in which when it is detected that the recording medium has reached the stop position by the position comparing means, and the conveying motor output switching means, the position comparing means generates an auto stop interrupt to inform that the output in accordance with the output-for-stop setting register is made effective, and make the output from the output-for-stop setting register effective a certain time after the occurrence of the auto stop interrupt.

6. The recording apparatus according to claim 5, wherein the servo computing means verifies the presence/absence of the auto stop interrupt and outputs the servo computing results only when the auto stop interrupt is absent.

7. The recording apparatus according to claim 5, wherein the conveying motor is a DC motor.

8. The recording apparatus according to claim 5, wherein the recording apparatus is an ink-jet recording apparatus.

* * * * *